US009284934B2

(12) United States Patent
Miyamoto et al.

(10) Patent No.: US 9,284,934 B2
(45) Date of Patent: Mar. 15, 2016

(54) PRESS MOLDED PRODUCT AND STOPPER FOR ENGINE STARTER

(75) Inventors: Mitsuru Miyamoto, Tokyo (JP); Hirofumi Miyoshi, Tokyo (JP); Kensuke Kato, Tokyo (JP); Junichi Imai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 488 days.

(21) Appl. No.: 13/495,771

(22) Filed: Jun. 13, 2012

(65) Prior Publication Data

US 2013/0186212 A1 Jul. 25, 2013

(30) Foreign Application Priority Data

Jan. 19, 2012 (JP) ..... 2012-008652

(51) Int. Cl.
*F02N 15/06* (2006.01)

(52) U.S. Cl.
CPC ..... *F02N 15/06* (2013.01); *F02N 2015/061* (2013.01); *Y10T 74/13* (2015.01); *Y10T 428/12993* (2015.01)

(58) Field of Classification Search
CPC ..... F02N 15/00; F02N 15/06; F02N 15/061; B25B 27/20; F16B 21/18; F16B 21/183
USPC ..... 74/6, 7 A, 7 B, 7 C, 7 R; 290/48; 403/359.5
See application file for complete search history.

(56) References Cited

U.S. PATENT DOCUMENTS

| | | | | |
|---|---|---|---|---|
| 2,252,328 | A * | 8/1941 | Martin | 74/7 B |
| 5,028,805 | A * | 7/1991 | Isozumi | 290/48 |
| 5,050,441 | A * | 9/1991 | Giometti | 74/7 C |
| 5,370,009 | A * | 12/1994 | Isozumi | 74/7 C |
| 6,389,914 | B1 * | 5/2002 | Hiruma et al. | 74/7 R |

FOREIGN PATENT DOCUMENTS

| | | | |
|---|---|---|---|
| JP | 63-205458 | A | 8/1988 |
| JP | 2001-241467 | A | 9/2001 |
| JP | 2010-253513 | A | 11/2010 |

OTHER PUBLICATIONS

Japanese Office Action dated Feb. 19, 2013, issued in corresponding Japanese Patent Application No. 2012-008652.

* cited by examiner

*Primary Examiner* — William Kelleher
*Assistant Examiner* — Jake Cook
(74) *Attorney, Agent, or Firm* — Sughrue Mion, PLLC

(57) ABSTRACT

A press molded product 1 that includes fitting portions 13 and 15, which can be fitted to another component 3, wherein the fitting portions include protruded portions 19 that can be contacted to the fitted other component 3, and the portions 19 are molded by press working.

9 Claims, 4 Drawing Sheets

CROSS-SECTIONAL VIEW ALONG LINE "A-A"

CROSS-SECTIONAL VIEW ALONG LINE "B-B"

PRESS MOLDED PRODUCT AND STOPPER FOR ENGINE STARTER

This application claims priority to Japanese Patent Application No. 2011-193671 filed on Sep. 6, 2011, the contents of which are herewith incorporated by reference in entirety.

BACKGROUND OF THE INVENTION

1. Technical Field

The present invention relates to a press molded product that is molded by press working, and relates to a stopper for an engine starter using the press molded product.

2. Background Art

FIG. 5 is a cross-sectional view illustrating a part of a conventional stopper for an engine starter. In FIG. 5, a center space portion of a stopper main body 1 formed in a circular shape is penetrated by an output shaft 2 configured as a spline shaft of a motor (not illustrated) of the engine starter, and the main body 1 is mounted around the output shaft 2. A snap ring 3 is mounted into a concave groove 21 having a circular shape, which is formed along an outer surface at a predefined position of the output shaft 2.

A fitting concave groove 13 including a fitting-holding tapered surface 11 and a side wall 12 is formed along an inner surface of the main body 1. Moreover, a fitting-guiding tapered surface 15, which is shaped in such a way that inner diameters are sequentially extended toward one end surface 14 of the stopper main body 1, is formed along the inner circumference surface of the stopper main body 1. A fitting portion of the stopper main body 1 is composed of the fitting concave groove 13 and the fitting-guiding tapered surface 15.

The stopper for the engine starter is configured in such a way that the snap ring 3 is fitted to the fitting portion of the stopper main body 1, and the stopper main body 1 is fixed at a predefined position of the output shaft 2. A pinion gear (not illustrated), which is mounted around the output shaft 2, moves along the output shaft 2 in the axial direction when the pinion gear is connected to a ring gear (not illustrated) of an engine. At this time, a movement of the pinion gear in the axial direction is stopped by being contacted to the other end surface 16 of the stopper main body 1.

Although the stopper main body 1 is configured by the press molded product that is coining-molded by press working for a metal material, the fitting-guiding tapered surface 15 and a fitting concave groove 13 of the fitting portion of the stopper main body 1 are formed as under-cut portions by press working for a whole circumference, after the metal material is coining-molded (for example, refer to Patent Document 1).

CONVENTIONAL ART DOCUMENT

Patent Document

Patent Document 1

Japanese Laid-Open Patent Publication No. 2010-253513

SUMMARY OF THE INVENTION

Problems to be Solved by the Invention

In a conventional stopper for an engine starter, a snap ring 3, which is fitted into a fitting concave groove 13 of the stopper main body 1, is prevented from passing by a fitting-holding tapered surface 11 and held in the fitting concave groove 13. However, when some kind of impact load or the like is applied in a axial direction of the stopper main body 1, there has been a possibility in which the stopper main body 1 is opposed to an elastic force of the snap ring 3 and moved toward a ring gear side, and the snap ring 3 is separated from the stopper main body 1 via the fitting concave groove 13 through a fitting-guiding tapered surface 15 of the stopper main body 1.

The present invention has been made to solve the above-described problems of a conventional stopper for an engine starter or the like, and an object of the invention is to provide a press molded product by which other component, such as a fitted snap ring, is not easily separated.

Moreover, another object of the invention is to provide a stopper for an engine starter, in which a snap ring is not easily separated from a stopper main body.

Means for Solving Problems

A press molded product of the present invention includes a fitting portion that can be fitted to other component, wherein the fitting portion includes a protruded portion that can be contacted to the fitted other component, and the protruded portion is molded by press working.

Moreover, a stopper for an engine starter of the present invention includes a protruded portion, in a fitting portion, which can be contacted to the fitted other component, and further includes a stopper main body that is configured by the press molded product on which the protruded portion is molded by press working, and a snap ring that is mounted around a output shaft of a starting motor for starting an engine, and fitted to the fitting portion of the stopper main body so as to hold the stopper main body at a predefined position in a axial direction of the output shaft, wherein the stopper main body is contacted to a pinion gear, which is mounted around the output shaft, for starting the engine so as to regulate a movement of the pinion gear in the axial direction.

Effects of the Invention

According to a press molded product of the present invention, when it is used, for example, as a stopper main body for a stopper for an engine starter, a snap ring contacted to a protruded portion is not separated from a fitting concave groove, even if some kind of impact load or the like is applied in a shaft direction of the stopper main body. Moreover, the protruded portion is molded by press working, so that rising manufacturing cost can be suppressed.

Furthermore, according to a stopper for an engine starter of the present invention, even if some kind of impact load or the like is applied in a shaft direction of the stopper main body, the protruded portion provided in a fitting portion of the stopper main body is contacted to the snap ring, whereby the snap ring is prevented from being separated from the fitting concave groove, and a cheap stopper for an engine starter can be obtained.

DETAILED DESCRIPTION OF THE PREFERRED EMBODIMENTS

Embodiment 1

Figure 1:
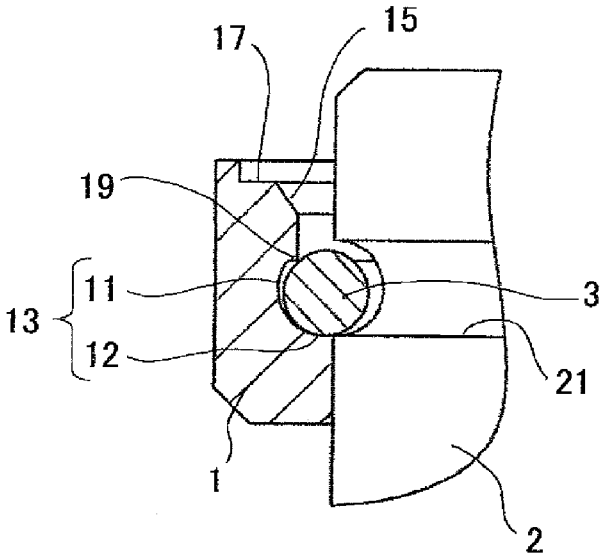
FIG. 1 is a cross-sectional view illustrating a part of a press molded product according to Embodiment 1 of the present invention.

FIG. 1 is a cross-sectional view illustrating a part of a press molded product according to Embodiment 1 of the present invention, and FIG. 1 indicates a case in which the press molded product is used as a stopper main body of a stopper for an engine starter according to Embodiment 1 of the present invention.

In FIG. 1, a center space portion of a circular stopper main body 1 configured as a press molded product is penetrated by an output shaft 2 configured as a spline shaft of a motor (not illustrated) of the engine starter, and the stopper main body 1 is mounted around the output shaft 2. A snap ring 3, which is a separate component with respect to the stopper main body 1, is mounted into a concave groove 21 having a circular shape, which is formed along an outer surface at a predefined position of the output shaft 2.

A fitting concave groove 13, which includes a fitting-holding tapered surface 11 and a side wall 12, is formed along an inner circumference surface of the stopper main body 1. Moreover, a fitting-guiding tapered surface 15, which is shaped in such a way that inner diameters are sequentially extended toward one end surface 14 of the stopper main body 1, is formed along the inner circumference surface of the stopper main body 1. A fitting portion of the stopper main body 1 is composed of the fitting concave groove 13 and the fitting-guiding tapered surface 15.

Figure 2A:
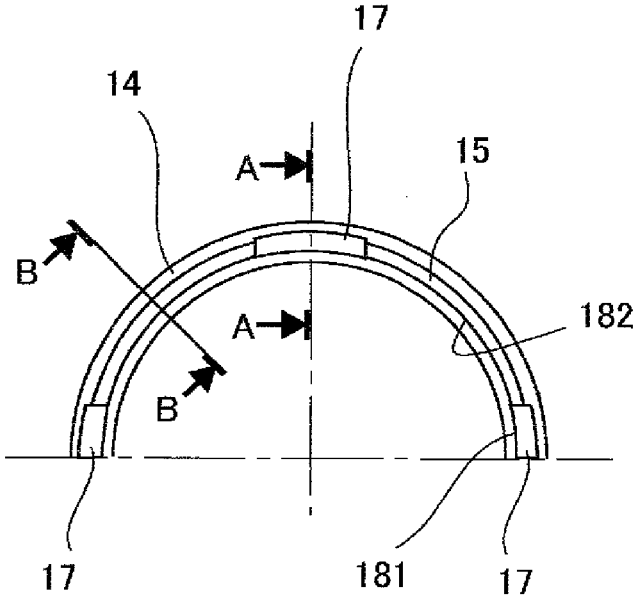
FIG. 2A is a front view illustrating a part of the press molded product according to Embodiment 1 of the present invention.
Figure 2B:
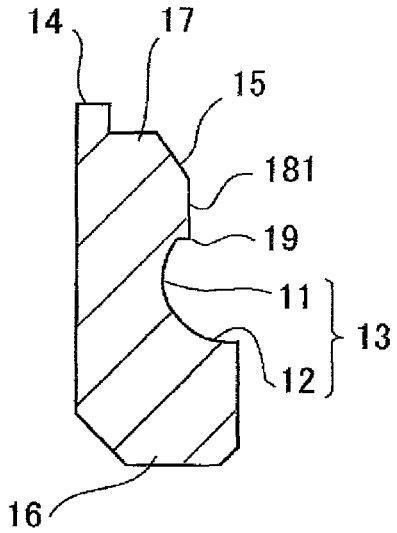
FIG. 2B is a cross-sectional view along a line "A-A" illustrated in FIG. 2A.
Figure 2C:
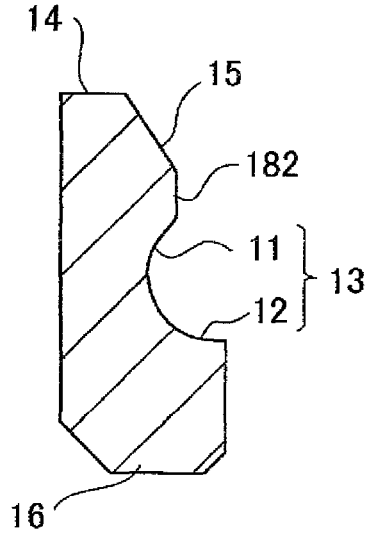
FIG. 2C is a cross-sectional view along a line "B-B" illustrated in FIG. 2A.

FIG. 2A is a front view illustrating a part of the press molded product according to Embodiment 1 of the present invention, FIG. 2B is a cross-sectional view along a line "A-A" illustrated in FIG. 2A, and FIG. 2C is a cross-sectional view along a line "B-B" illustrated in FIG. 2A. The stopper main body 1 of the above-described stopper for an engine starter, which is illustrated in FIG. 1, is configured by the press molded product illustrated in FIG. 2A through FIG. 2C. In FIG. 2A through FIG. 2*c*, the stopper main body 1 configured by the press molded product is formed in a circular shape as described above, and four circular concave portions 17 are formed at the end surface 14 in a shaft direction of the stopper main body 1. As clearly illustrated in FIG. 2A, the four circular concave portions 17 are spaced every 90-degree angle and arranged around an axis "X" of the stopper main body 1.

As clearly illustrated in FIG. 2B, an inner end portion in a radius direction of each of the circular concave portions 17 is led to an inner circumference surface 181, which is extended in the axial direction, via the fitting-guiding tapered surface 15. The stopper main body 1 is formed in such a way that a axial direction length of the inner circumference surface 181, which is led to the inner end portion in the radius direction of each of the circular concave portions 17, is longer than a axial direction length of other inner circumference surface 182 (refer to FIG. 2C). Moreover, the inner circumference surface 181 is formed so as to be protruded into the fitting concave groove 13 in accordance with the axial direction length of the inner circumference surface 181, which is longer than the axial direction length of the other inner circumference surface 182.

In other words, protruded portions 19 are formed from the inner circumference surface 181 protruded into the fitting concave groove 13. Therefore, four protruded portions 19 are formed in accordance with the four circular concave portions 17, and the four protruded portions 19 are spaced every 90-degree angle and arranged around the axis X. The four protruded portions 19 are formed in a circular shape in accordance with a shape of the circular concave portions 17. As described above, the fitting portion of the stopper main body 1, which is configured by the fitting concave groove 13 and the fitting-guiding tapered surface 15, includes the four protruded portions 19.

The stopper for the engine starter is configured in such a way that the snap ring 3 is fitted to the fitting portion of the stopper main body 1, which is configured as described above, and the stopper main body 1 is fixed at a predefined position of the output shaft 2. A pinion gear (not illustrated in FIG. 2), which is mounted around the output shaft 2, moves along the output shaft 2 in the axial direction when the pinion gear is connected to a ring gear (not illustrated) of an engine. At this time, a movement of the pinion gear in the axial direction is stopped by being contacted to the other end surface 16 of the stopper main body 1.

Although the stopper main body 1 is configured by the press molded product that is coining-molded by press working for a metal material, the fitting-guiding tapered surface 15, the circular concave portions 17, the fitting concave groove 13, and protruded portions 19, which are formed at the fitting portion of the stopper main body 1, are formed as under-cut portions by press working for a whole circumference, after the metal material is coining-molded.

A mold required to press and mold the above-described fitting-guiding tapered surface 15, the circular concave portions 17, and protruded portions 19 can be configured, for example, as a part of a progressive mold, so that the protruded portions 19 can be formed without deteriorating production efficiency. Moreover, when the mold is configured as the part of the progressive mold as described above, another process is not required, so that a cost of the stopper can be suppressed.

The stopper main body 1 configured as the press molded product, which is formed as described above, is fitted to the snap ring 3 so as to be mounted at the predefined position of the output shaft 2 as illustrated in FIG. 1. However, each of the four protruded portions 19 is contacted to the circumference surface of the snap ring 3, so that a dropout of the snap ring 3 is increased in comparison with another dropout load of the snap ring 3 in a case where only the fitting-holding tapered surface 11 in the conventional fitting concave groove 13 is contacted to the circumference surface of the snap ring 3. Moreover, even if some kind of impact load or the like is applied to the snap ring 3 in the axial direction of the stopper main body 1, the snap ring 3 is not separated from the fitting concave groove 13. Moreover, according to Embodiment 1 of the present invention, the four protruded portions 19 are spaced every 90-degree angle and arranged around the axis X, so that the snap ring 3 can be constantly held. In addition, the number of the protruded portions 19 is not limited to four, and one protruded portion or any number of protruded portions can be arranged.

The four protruded portions 19 are formed in a circular shape as described above, so that a contact area of the protruded portions 19 and the circular snap ring 3 is increased, and a stress at a contact portion is reduced, whereby the snap ring 3 can be constantly held.

Moreover, the portions 19 are not serially provided along a whole circumference of the fitting portion, and those are spaced every predefined distance and decentrally provided, so that the portions 19 don't interfere with the insertion of the snap ring 3, when the circular snap ring 3 is fitted into the fitting concave groove 13.

Figure 3:
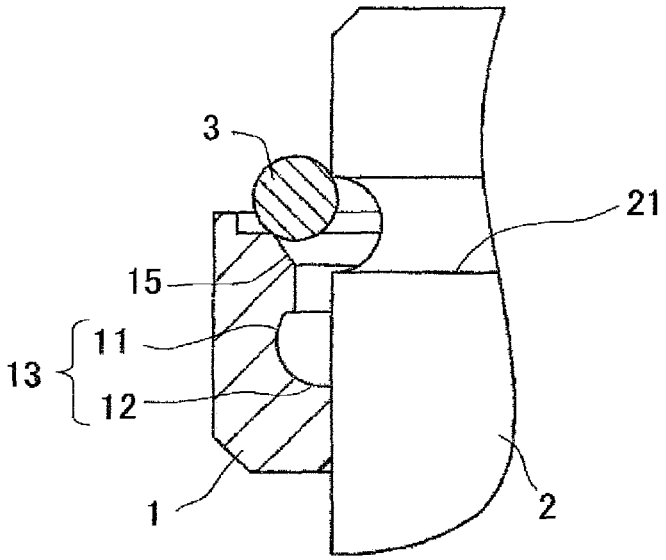
FIG. 3 is an explanatory diagrams for explaining a process in which other component is fitted to the press molded product according to Embodiment 1 of the present invention.

FIG. 3 is an explanatory diagrams for explaining a process in which other component is fitted to the press molded product according to Embodiment 1 of the present invention, and FIG. 3 indicates a case in which the press molded product is used as a stopper main body of a stopper for an engine starter as described above. As illustrated in FIG. 3, when the snap ring 3 configured as the other component is fitted to the stopper main body 1 configured as the press molded product, the fitting-guiding tapered surface 15 and the circular concave portions 17 of the stopper main body 1 are contacted to the snap ring 3, from a lower side in FIG. 3, which is mounted into the concave groove 21 of the output shaft 2, so as to press the snap ring 3. The snap ring 3 is pressed, by the fitting-guiding tapered surface 15, and fitted into the fitting concave groove 13 while the radiuses of the snap ring 3 are sequentially reduced.

When the snap ring 3 is fitted into the fitting concave groove 13, a radius of the snap ring 3 is extended by its elastic force, and the snap ring 3 is contacted to an inner surface of the fitting concave groove 13 and the protruded portions 19, whereby the snap ring 3 is constantly held at the position. The stopper main body 1 is held at a predefined position of the output shaft 2 by being fitted to the snap ring 3.

Figure 4:
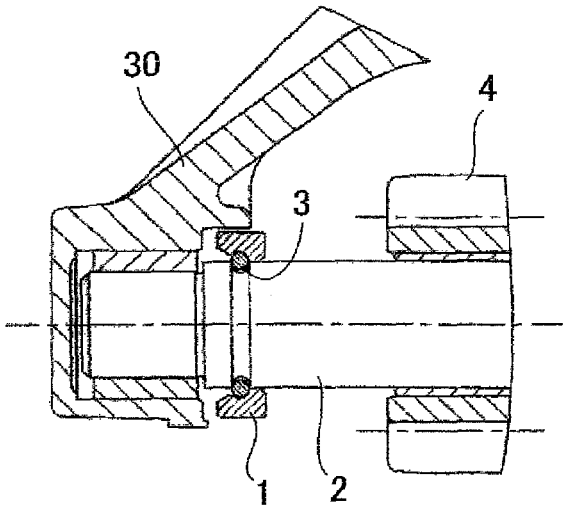
FIG. 4 is a cross-sectional view illustrating a stopper for an engine starter according to Embodiment 1 of the present invention.
Figure 5:
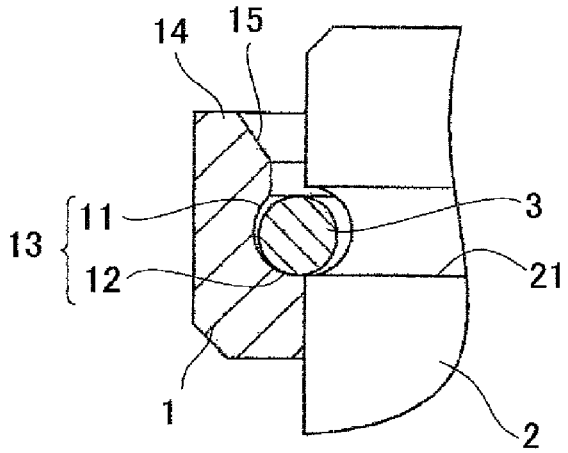
FIG. 5 (Prior Art)
FIG. 5 is a cross-sectional view illustrating a part of a conventional stopper for an engine starter.

FIG. 4 is a cross-sectional view illustrating a stopper for an engine starter according to Embodiment 1 of the present invention. In FIG. 4, a pinion gear 4 is movable in the axial direction and mounted around a portion formed on the output shaft 2, configured as a spline shaft of a motor, which is rotatably sustained in a case 30 of the engine starter. The stopper main body 1 configured as described above is mounted at a predefined position of the output shaft 2. The pinion gear 4 rotated in accordance with a rotation of the output shaft 2 is moved, by a lever (not illustrated), in a left direction in FIG. 4, whereby the pinion gear 4 is engaged to a ring gear (not illustrated) of the engine so as to start the engine. However, at this time, the stopper main body 1 is contacted to the pinion gear 4, whereby it is stopped by the stopper main body 1 that the pinion gear 4 is more moved in a left direction in FIG. 4.

In addition, each of components according to Embodiment 1 of the present invention can be suitably modified or omitted within the scope of the present invention.

What is claimed is:

1. A press molded product comprising:

a fitting portion that can be fitted to another component; wherein the fitting portion includes a protruded portion that can be contacted to the other component, the fitting portion includes a concave groove formed along an inner circumferential surface of the press molded product and formed continuously for substantially a whole circumference of the press molded product, the protruded portion protrudes into the concave groove of the fitting portion in an axial direction of the press molded product, the fitting portion is formed in a circular shape in a plane perpendicular to the axial direction, the press molded product is a single component, and the protruded portion is molded by press working.

2. A press molded product according to claim 1, wherein a plurality of protruded portions are provided at the fitting portion in a state where the plurality of protruded portions are spaced apart.

3. A press molded product according to claim 2, wherein the plurality of protruded portions are provided around an axis of the fitting portion in a state where the plurality of protruded portions are uniformly spaced at a predefined angle.

4. A press molded product according to claim 3, wherein the predefined angle is 90 degrees, and four protruded portions are provided.

5. A press molded product according to claim 2, wherein the other component is formed in a ring shape, and the protruded portions are formed in a circular shape with respect to a ring-shaped portion of the other component.

6. A press molded product according to claim 1, wherein the fitting portion includes a fitting-guiding tapered surface that guides the other component in a direction where the other component is fitted to the fitting portion.

7. A press molded product according to claim 1, wherein the fitting portion includes a fitting-holding tapered surface that applies drag, which prevents the other component from being separated from the fitting portion, to the other component.

8. A stopper for an engine starter, comprising:

the press molded product according to claim 1; and a snap ring that is mounted around an output shaft of a starting motor for starting an engine and fitted to the fitting portion of the press molded product so as to hold the press molded product at a predefined position in a axial direction of the output shaft; wherein the press molded product is contacted to a pinion gear, which is mounted around the output shaft, for starting the engine so as to regulate a movement of the pinion gear in the shaft direction, and the press molded product is a stopper main body.

9. A press molded product according to claim 1, wherein an axial direction length of an inner circumferential surface of the protruded portion is longer than an axial direction length of an inner circumferential surface of another portion of the fitting portion.

* * * * *